US010563457B2

(12) United States Patent
West et al.

(10) Patent No.: US 10,563,457 B2
(45) Date of Patent: Feb. 18, 2020

(54) PHOTOVOLTAIC MODULE HOIST

(71) Applicant: SolarCity Corporation, San Mateo, CA (US)

(72) Inventors: Brian D. West, San Rafael, CA (US); Benjamin T. Materna, San Rafael, CA (US); William P. Buchanan, San Rafael, CA (US); Kathryn A. Pesce, San Rafael, CA (US); Dana K. Noyes, Farmer Branch, TX (US)

(73) Assignee: SolarCity Corporation, San Mateo, CA (US)

( * ) Notice: Subject to any disclaimer, the term of this patent is extended or adjusted under 35 U.S.C. 154(b) by 123 days.

(21) Appl. No.: 14/814,352

(22) Filed: Jul. 30, 2015

(65) Prior Publication Data

US 2016/0201391 A1 Jul. 14, 2016

Related U.S. Application Data

(60) Provisional application No. 62/102,399, filed on Jan. 12, 2015.

(51) Int. Cl.
*E06C 7/12* (2006.01)
*E06C 7/48* (2006.01)

(52) U.S. Cl.
CPC . *E06C 7/12* (2013.01); *E06C 7/48* (2013.01)

(58) Field of Classification Search
CPC ..... E06C 7/12
See application file for complete search history.

(56) References Cited

U.S. PATENT DOCUMENTS 1,356,774 A * 10/1920 Lanchester ..... B62D 25/105 16/232
1,483,097 A * 2/1924 Kline ..... E05B 83/243 16/443
3,115,211 A * 12/1963 Ostrander, Jr. ..... E06C 7/12 182/103
3,666,054 A * 5/1972 Ellings ..... E06C 7/16 182/103
4,546,853 A * 10/1985 Hanson ..... E06C 7/16 182/103
5,911,287 A * 6/1999 Campbell ..... E06C 7/48 182/103
8,002,512 B1 * 8/2011 Blehm ..... B66B 9/193 182/103

(Continued)

OTHER PUBLICATIONS

Intech Equipment and Supply, "Classic 200E Laddervator 28ft 200" (retrieved on May 16, 2015 from http://www.intechequipment.com/store/p-44561-classic-200e-laddervator-28ft-200-lb.aspx).

(Continued)

*Primary Examiner* — Alvin C Chin-Shue
(74) *Attorney, Agent, or Firm* — Kilpatrick Townsend & Stockton LLP

(57) ABSTRACT

A hand-powered photovoltaic module hoist having a sled that slides along a ladder, and a pulley assembly mounted at the top of the ladder with a first cord to lift the sled and a second safety release cord to permit the sled to descend down the ladder. The sled is not attached to the ladder and the pulley assembly is a removable frame that is hung onto rungs of the ladder such that the hoist can quickly be installed on a standard ladder.

14 Claims, 22 Drawing Sheets

(56) References Cited

U.S. PATENT DOCUMENTS

| | | | | |
|---|---|---|---|---|
| 2008/0203371 | A1* | 8/2008 | Mauthner | B66D 3/08 254/391 |
| 2009/0057057 | A1* | 3/2009 | Sracic | E06C 7/12 182/141 |
| 2013/0287531 | A1* | 10/2013 | Connors | B66B 9/193 414/598 |
| 2015/0273250 | A1* | 10/2015 | Bina | A62B 99/00 182/8 |
| 2015/0300090 | A1* | 10/2015 | Strand | E06C 7/12 182/103 |

OTHER PUBLICATIONS

Intech Equipment and Supply, "HandiHoists" (retrieved on May 16, 2015 from http://www.intechequipment.com/store/c-899-handihoists.aspx).

Gardner, Ken, "PV Module Lift", Home Power Magazine, Issue 143, Jun./Jul. 2011.

"Solar Panel Lift", Crane Tech Solutions (retrieved on May 16, 2015 from http://www.boeckeramericas.com/Toplift%20Fly%20er.pdf).

* cited by examiner

PHOTOVOLTAIC MODULE HOIST

RELATED APPLICATION

This claims priority to U.S. Provisional Patent Application No. 62/102,399, entitled "Photovoltaic Module Hoist", filed Jan. 12, 2015. This provisional application is hereby incorporated in its entirety by reference for all purposes.

TECHNICAL FIELD

The present invention relates to material hoists and to systems for lifting materials and supplies up onto building roofs.

BACKGROUND

The growth of photovoltaic arrays on building roofs has skyrocketed in recent years. As consumer demand for installing photovoltaic arrays continues to rise, companies are racing to meet customer demand. The quicker the array can be assembled on the customer's roof, the more profitable the whole operation becomes. As a result, demand currently exists for systems to quickly and efficiently hoist the photovoltaic modules up onto the roof.

Traditionally, photovoltaic modules may be lifted either by large, expensive motorized hoists, or even by crane. Use of such large, motorized systems add costs to the installation of the array. Moreover, simply lifting modules up a ladder without using a hoist can result is dropped modules. Pulling modules upwardly with a rope is also unsafe (especially in high winds), and ergonomically not desirable.

SUMMARY

The present invention provides an inexpensive and easy to operate hoist for lifting photovoltaic modules up onto a building roof. It is safe, easy to use, and rapidly deployable in the field. Being manually operable, it saves considerable expense as compared to current large, motorized hoisting systems.

In one embodiment, the present system provides a hand-powered photovoltaic module hoist, which can include a sled that slides up and down along a ladder with a pulley assembly mounted at the top of the ladder, a lifting cord connecting the pulley assembly to the sled, wherein an operator manually pulls the lifting cord to lift the sled up the ladder, and a safety release cord connected to the pulley assembly, wherein an operator pulls the safety release cord to permit the sled to descend down the ladder. In various embodiments, the sled wraps around the front and sides of the ladder, without being attached to the ladder.

In other embodiments, the sled can include a top edge that is angled outwardly, and a bottom support dimensioned to receive a photovoltaic module thereon, a non-stick surface on an inner ladder-contacting surface of the frame, and a photovoltaic module lock on the frame for securing photovoltaic modules to the sled. As such, the present system also can operate over sectional ladders, passing easily over the overlapping sections of the ladder. The non-stick surface makes travel up and down travel of the sled faster and easier.

In some embodiments, it can include a module lift assembly including a hand-powered photovoltaic module hoist sled and an adjustable roof standoff.

An optional standoff can be included, having has a pair of adjustable legs which each can be varied both in angle and length permitting the system to be used on a variety of roof geometries, while still providing excellent stability.

Additionally, the hoist preferably includes a photovoltaic module lock on the sled for securing photovoltaic modules to the sled. This module lock preferably comprises a catch biased downwardly by a spring and a hand lever. In operation, an installer lifts the lock and then rotates it to pass over the top surfaces of a pair of modules on the sled. The catch then springs downwardly, holding the pair of modules firmly in position during the lift.

DETAILED DESCRIPTION OF THE DRAWINGS

The present system provides a hand-powered module hoist for lifting photovoltaic modules from the ground onto a roof. It includes two-pieces: a sled and a pulley assembly. Each of the sled and the pulley assemblies can be separately mounted onto a standard sectional ladder. As such, the present hoist system does not need to be shipped together with the ladder.

The hoist is manually operable and can include a first cord for the operator to pull to lift the sled and a second safety release cord (which when pulled) permits the sled to move down the ladder. In optional embodiments, the system further comprises an additional standoff having separately adjustable legs that aid in placement on different roof surfaces and geometries. It is easy for an installer to operate by hand. No lifting motor is required, making it less expensive, quieter and lighter. Additionally, as the present system is attached onto existing ladders, it is small and easy to ship. However, as will be shown, it is still convenient for an installer to operate. For example, by using a 3-loop pulley, the installer is able to hold or lower the sled (with or without photovoltaic modules thereon) with only one hand. The present hoisting systems has many other advantages, as will be shown below.

Figure 1:
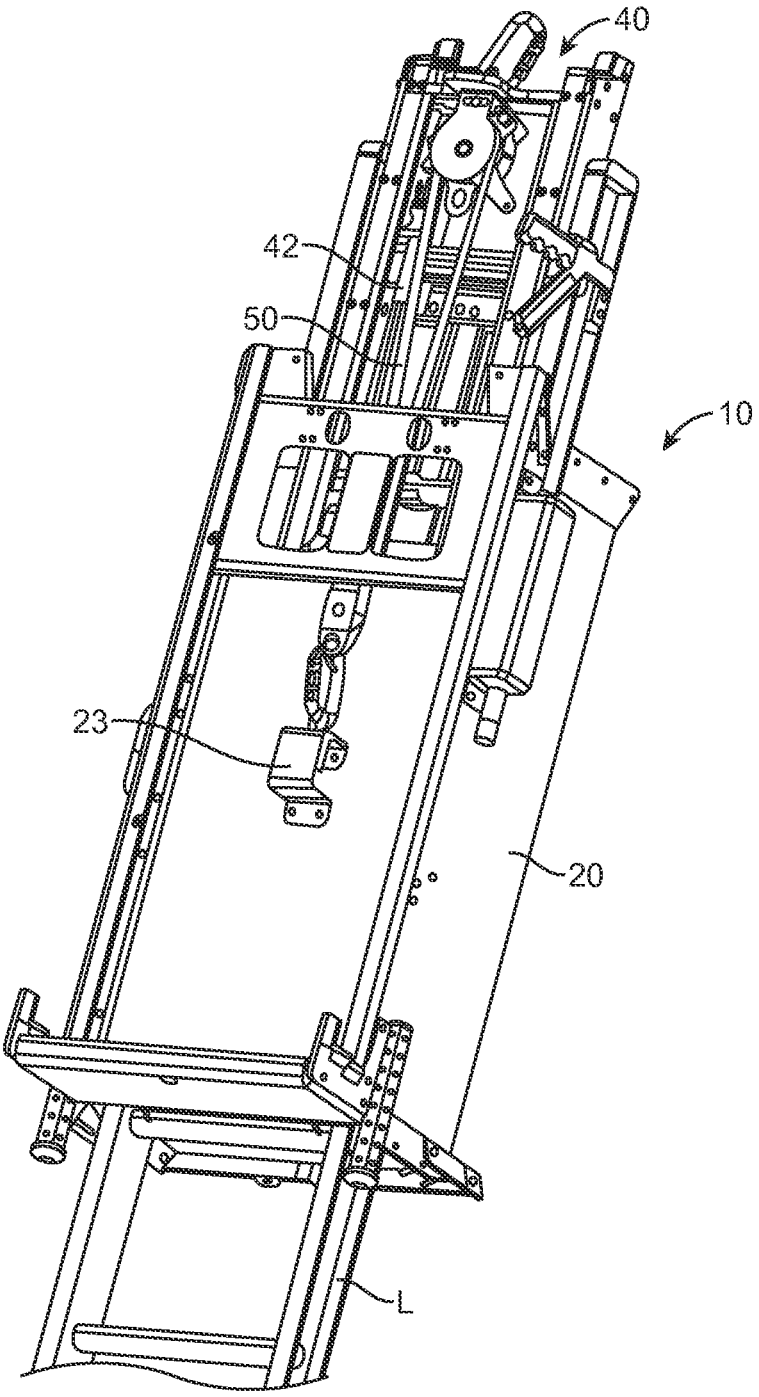
FIG. 1 is a perspective view of the present system installed on the top end of a ladder.

Referring first to FIG. 1, hoist 10 is shown installed onto ladder L. Hoist 10 may include two basic parts: sled 20 and pulley assembly 40. Sled 20 slides along the front of ladder L after the ladder has been positioned leaning against the side of a building. Pulley assembly 40 is preferably mounted at the top of ladder L (for example by being simply hung onto the rungs of the ladder as will be shown). A lifting cord 50 is connected to pulleys on both pulley assembly 40 and sled 20, with a free end of lifting cord 50 hanging down for an operator to manually grab onto and pull, thereby lifting sled 20 up along the front of ladder 40. A safety release cord 52 (FIG. 2) is also preferably included and connected to pulley assembly 40. In operation, the operator pulls safety release cord 52 to permit the sled to move down the ladder. Safety release cord 52 is preferably connected to an optional brake mechanism within the pulley assembly, and sled 40 preferably only moves down the ladder when the operator is pulling on safety release cord 52.

As a result, hoist 10 is safe for an installer to use. Specifically, in some embodiments, the photovoltaic modules will not fall to the ground should the installer accidentally let go of lifting chord 50. Rather, the installer must maintain a continuous pull on safety cord 52 when lowering the modules (or when simply lowering sled 20 after the modules have been removed from sled 20 at the top end of ladder L). Should the operator inadvertently release safety cord 52, sled 20 and modules will not fall to the ground. Additionally, the system is safe since both the photovoltaic modules are secured to sled 20 and sled 20 is in turn secured to ladder L. This secures the modules from falling in high winds.

Figure 2:
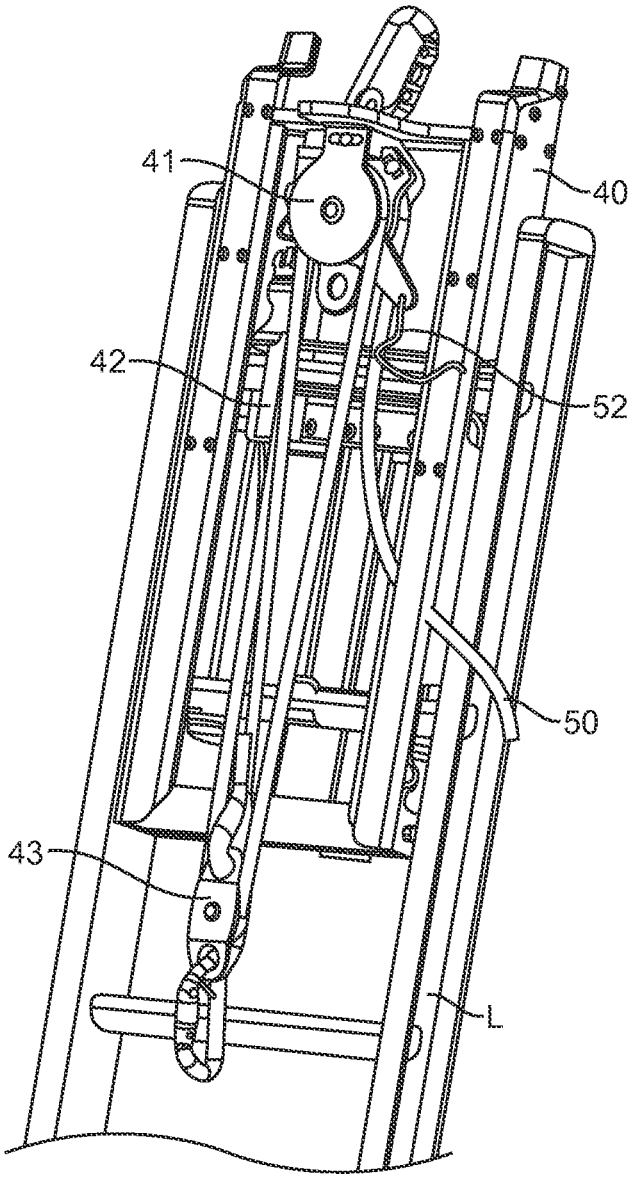
FIG. 2 is a view similar to FIG. 1, but with the sled removed.

FIG. 2 shows further details of lifting cord 50 wrapping around pulley 41 on the pulley assembly and pulley 43 that is attached to sled 20. (Note: the free end of lifting cord 50 and safety cord 52 have been truncated in the illustration, but both may hang down to where the operator is standing on the ground).

Figure 3A:
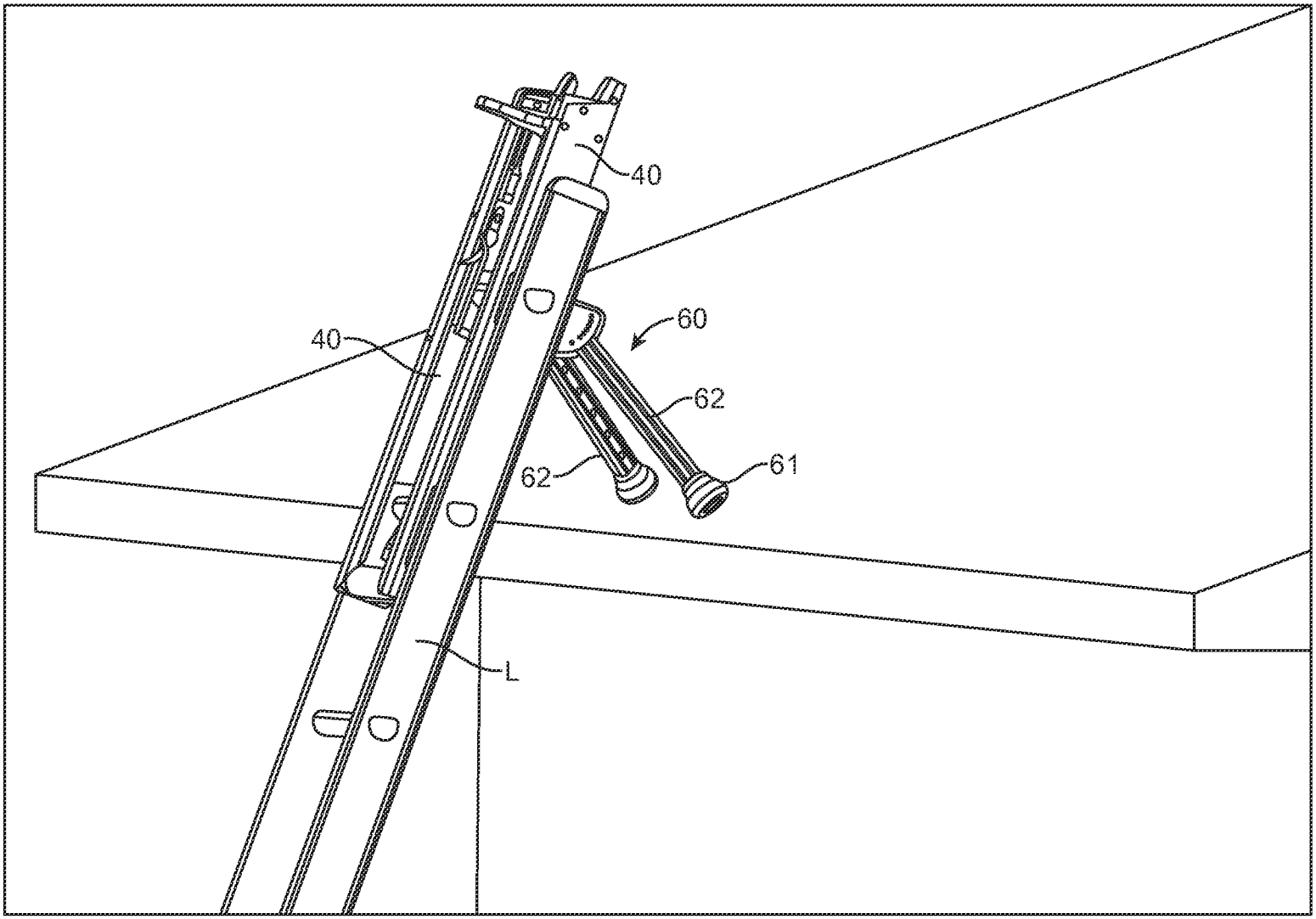
FIG. 3A is a perspective view of the present system installed on the top end of a ladder, with an optional mounting standoff sitting on the edge of a building roof.
Figure 3B:
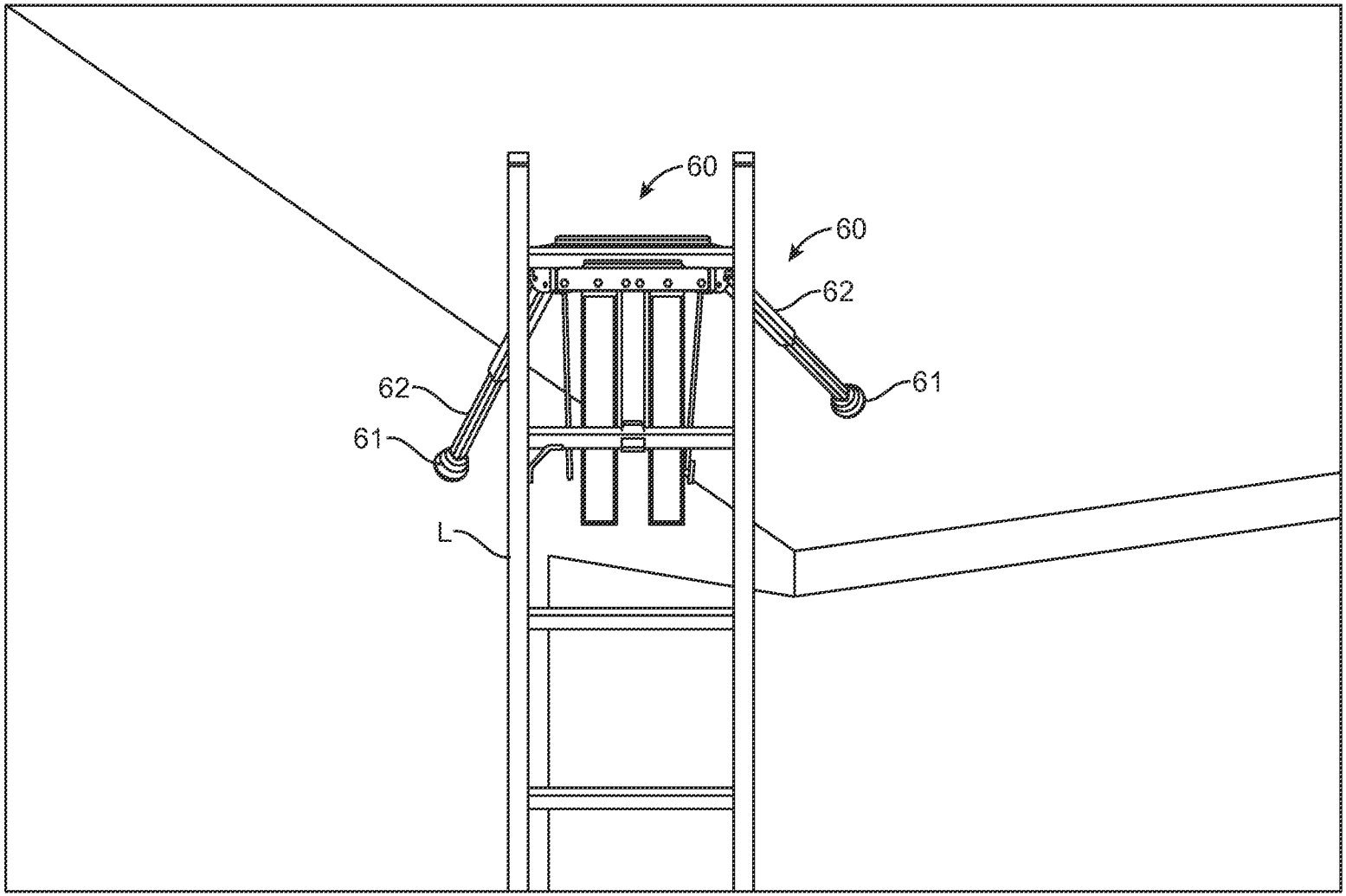
FIG. 3B is a close-up view corresponding to FIG. 3A.
Figure 3C:
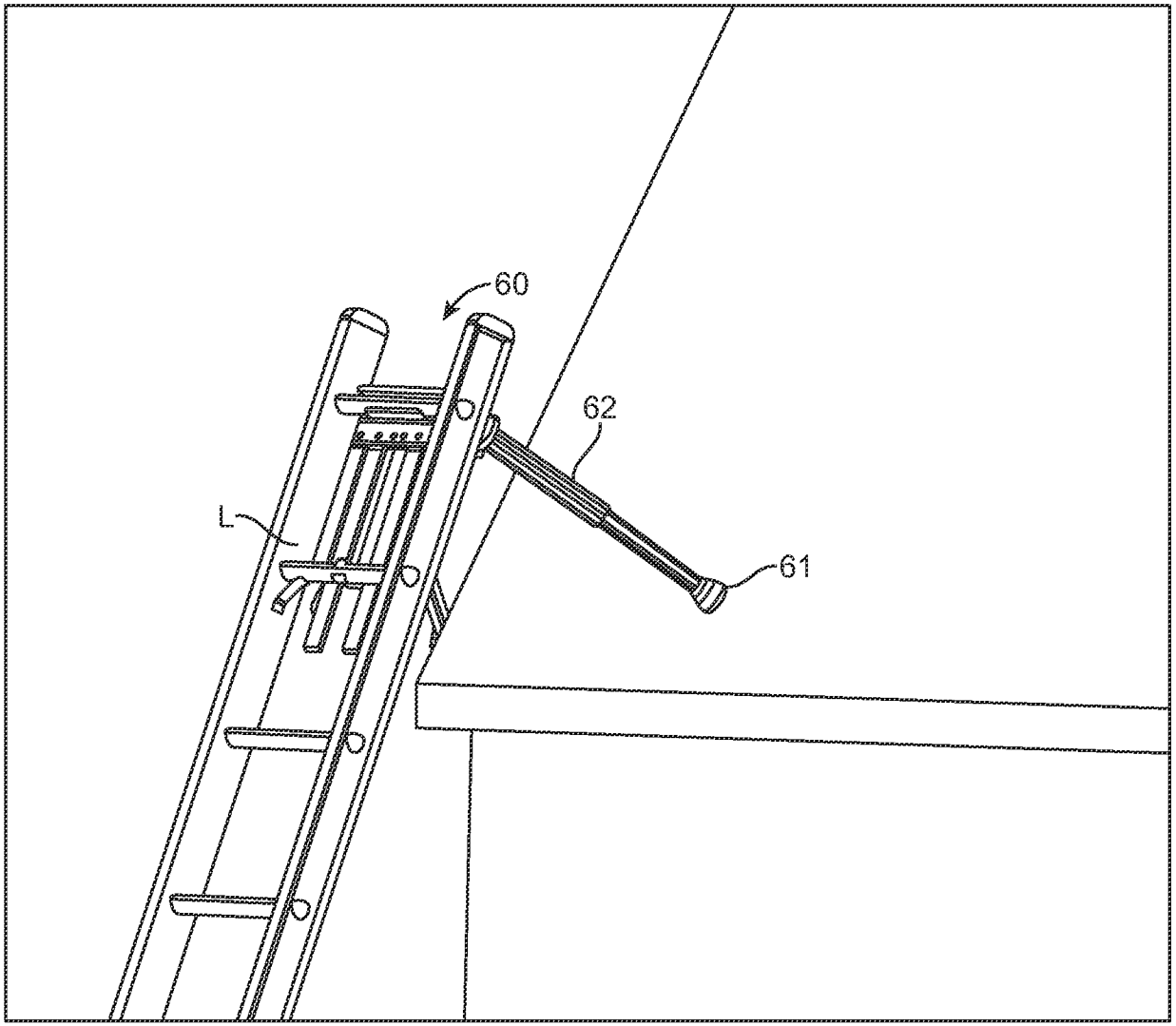
FIG. 3C corresponds to FIGS. 3A and 3B, showing only the mounting standoff at the top of the ladder.

FIGS. 3A, 3B and 3C illustrate the top end of the ladder L leaning against the roof of a building. An optional roof standoff 60 is shown. Roof standoff 60 comprises a frame with a pair of legs 62 extending therefrom, and provides stability for the top end of the ladder with its optional gripping structure (such as treads or caps 61) on the end of the legs. As will be explained below, both the angle and length of each of standoff 60's legs may be separately adjustable. For example, FIGS. 3A, 3B and 3C show legs 62 positioned at different angles from one another. Additionally, the lengths of legs 62 can be separately adjusted. By changing both the angle and length of the legs 62 individually, the present roof standoff 60 can assist the installer in placing ladder L at a wide variety of different locations against the roof edge. FIG. 3C shows the present standoff in use as a separate device at the top of the ladder L with the pulley assembly 40 removed. The present standoff 60 can be used as a stand-alone device, for example, used on a ladder different from the one used to hoist photovoltaic modules onto the roof.

Figure 4:
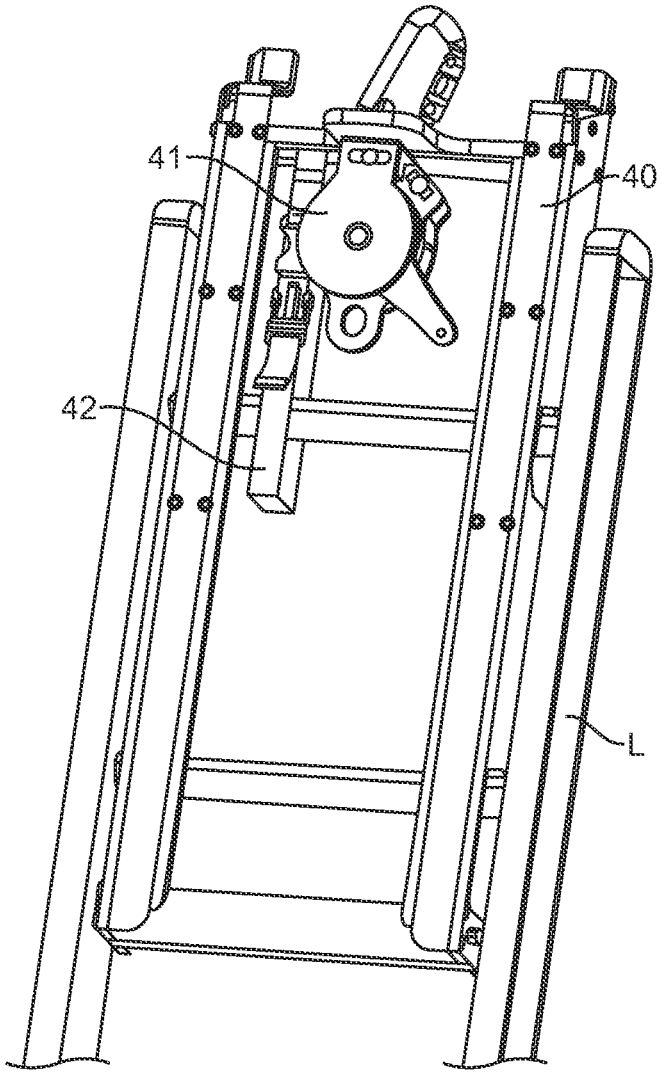
FIG. 4 is a perspective view of the pulley assembly placed at the top of the ladder.

FIG. 4 illustrates a perspective view of pulley assembly 40 sitting on the top rungs of the ladder L Optionally, a strap 42 can be included to wrap around the rungs of the ladder, thereby further securing pulley assembly 40 to the ladder. Strap 42 allows the attachment of pulley assembly 40 onto ladder L to be made quickly and easily. The present system comprises two basic parts (sled 20 and pulley assembly 40) which are both removable from the ladder itself. As a result, the present system can be quickly installed onto any existing ladder. Rather, the present system can be used with different ladders. This makes shipping of the present system very economical. Preferably as well, pulley assembly 40 comprises a removable frame that is simply hung onto the rungs of the ladder.

Figure 5A:
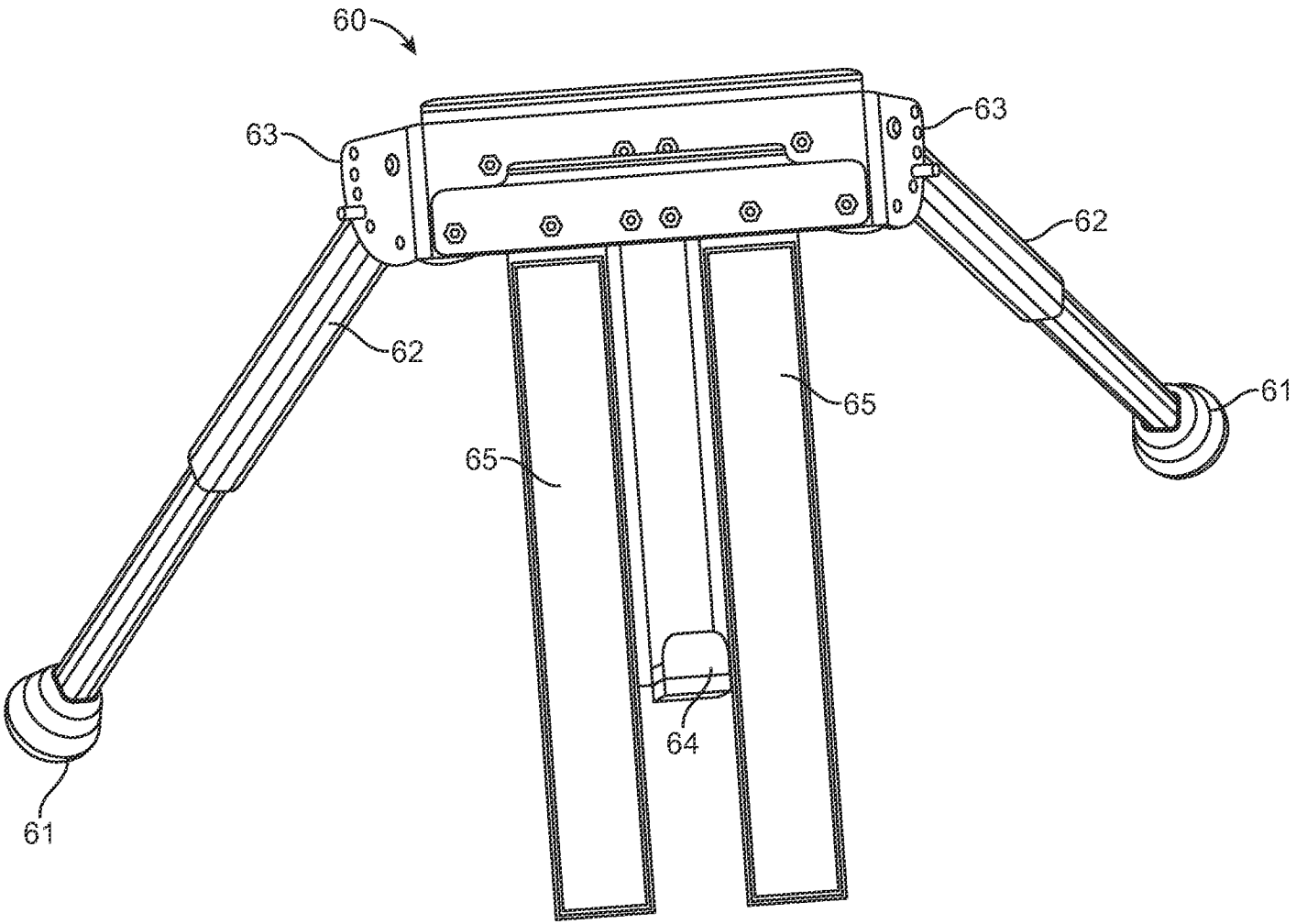
FIG. 5A is a first perspective view of the optional roof standoff.
Figure 5B:
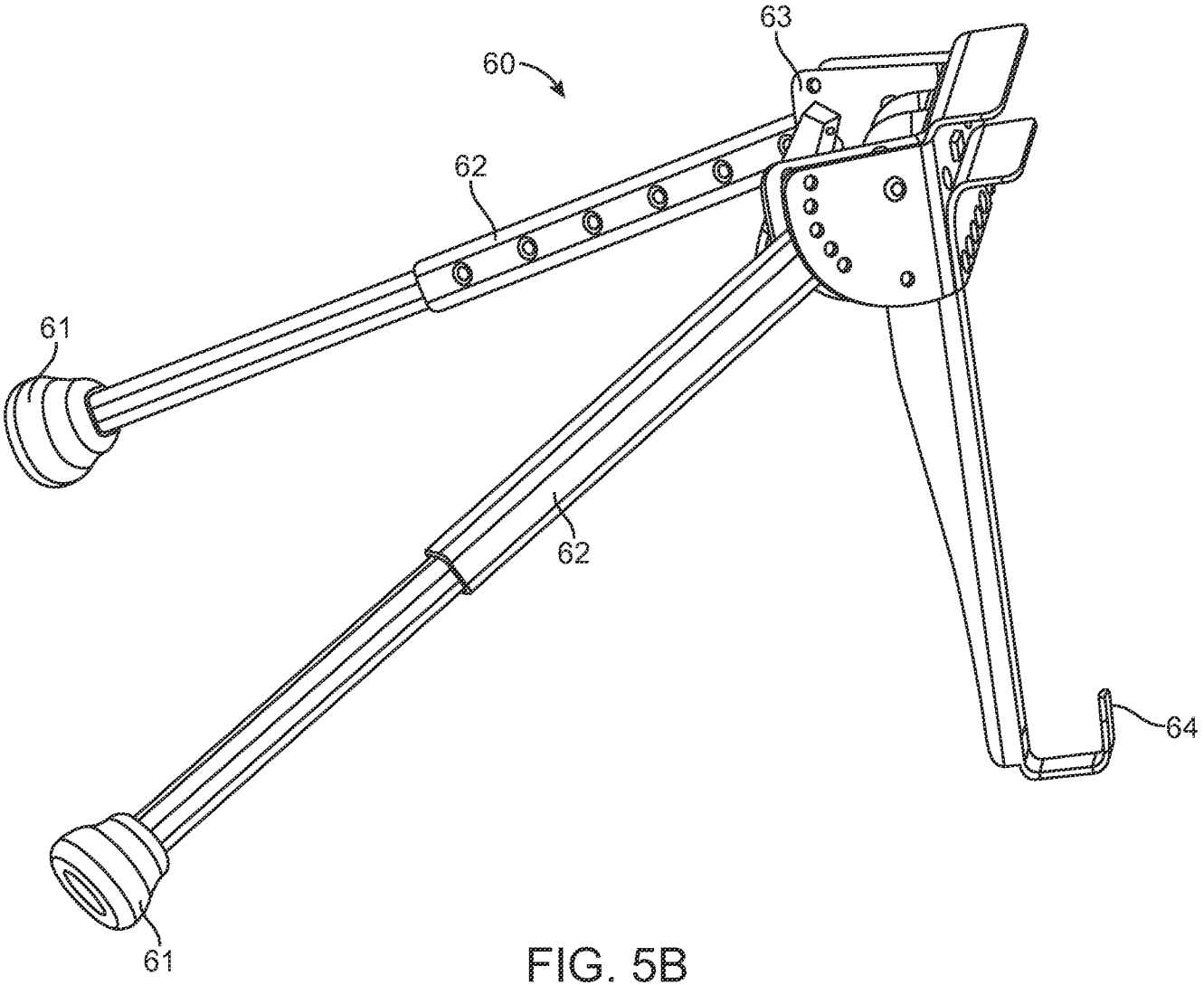
FIG. 5B is another view of the optional roof standoff of FIG. 5A.
Figure 5C:
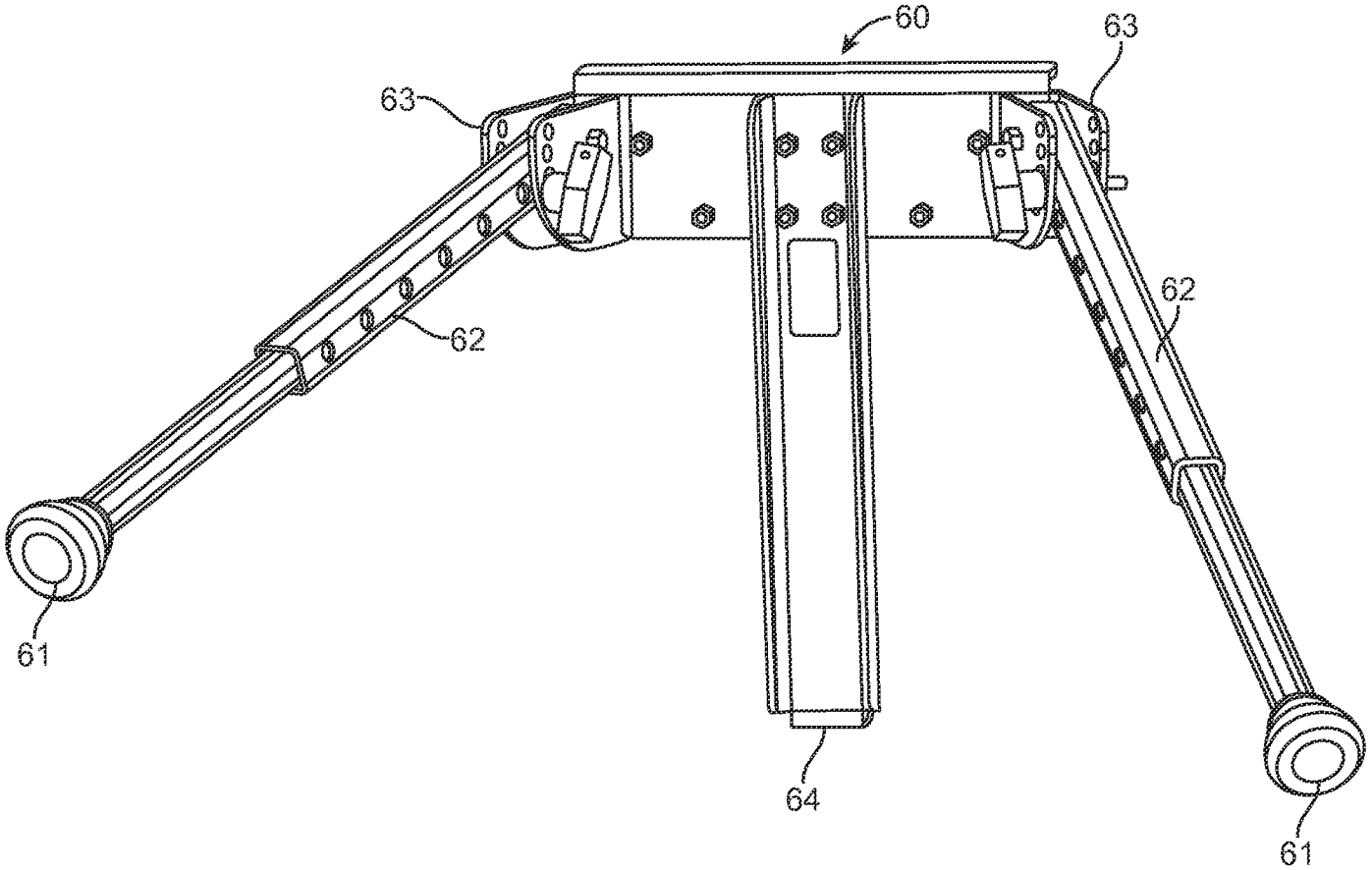
FIG. 5C is another view of the optional roof standoff of FIG. 5A.

FIGS. 5A, 5B and 5C show further details of standoff 60. Standoff 60 preferably has pair of legs 62 that are each separately adjustable to accommodate different roof geometries. Specifically, each leg 62 has a top mount 63 that is adjustable to a variety of angles such that the angle between ladder L and each of legs 62 can be separately adjustable. In addition, each leg 62 may preferably telescope in length. The mechanisms used to adjust the angle of each leg in top mount 63 and the mechanism to adjust the length of each of legs 62 may be push-pins received through holes, as illustrated. Additionally, standoff 60 can be secured to ladder L by way of hook 64 received around the bottom of one of the rungs of the ladder. Additionally, a pair of hook-and-loop fastener straps 65 can each be wrapped around the same rung of the ladder, securing the standoff to the ladder.

Figure 6:
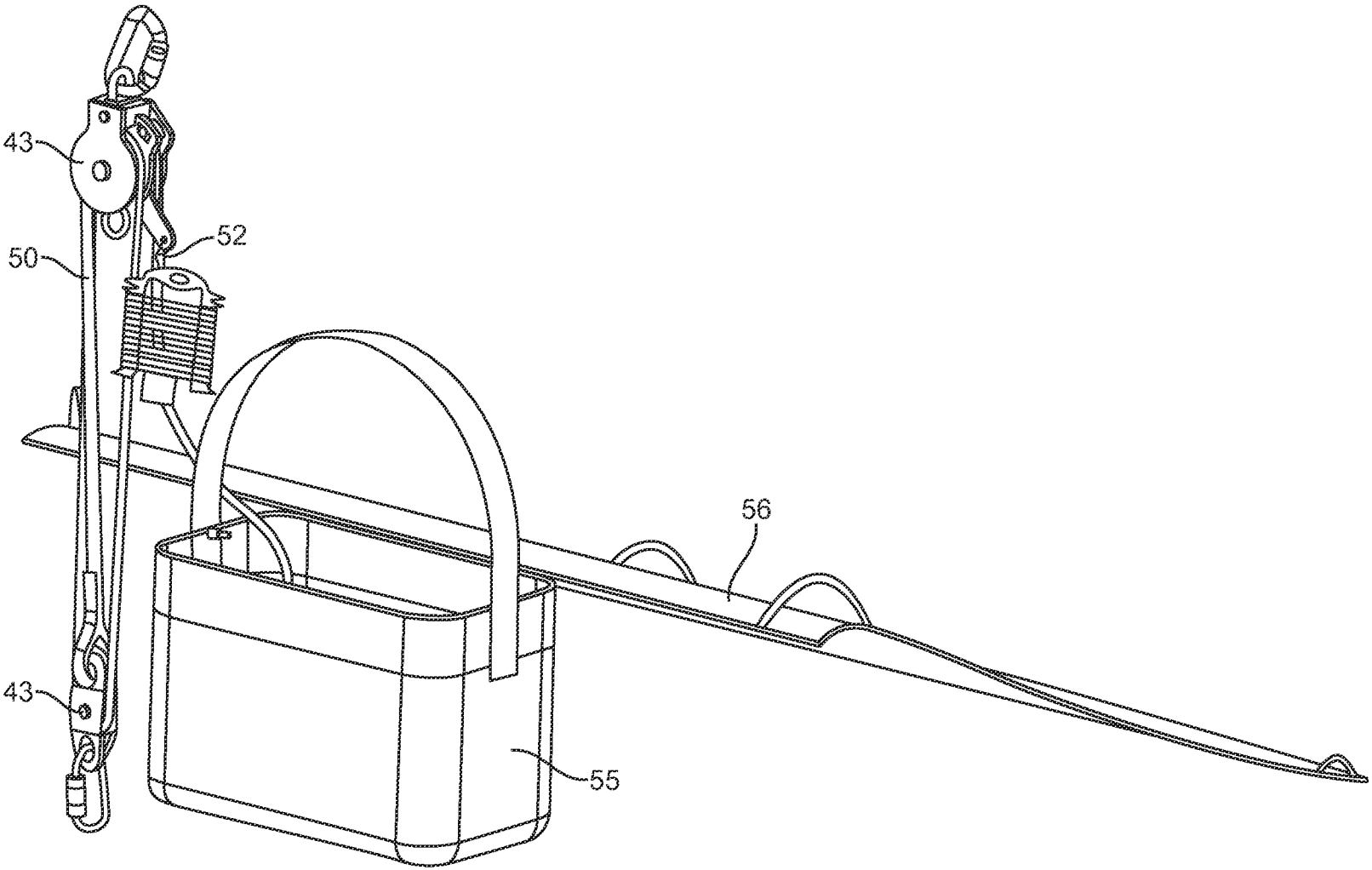
FIG. 6 is a perspective view of the pulley assembly and components used therewith.

FIG. 6 is a perspective view of the pulley assembly and components used therewith. Specifically, for convenience, the free end of lift cord 50 can be stored in bag 55 during transportation to the jobsite. When lift cord 50 has been removed from bag 55, then bag 55 can optionally be used by the installers for carrying tools or other accessories up onto the roof. An optional tarp 56 can also be included, and can be used to provide a clean, dry surface for the installer to stand on and for the cord 50 to descend onto the tarp without it becoming wet or dirty.

Figure 7:
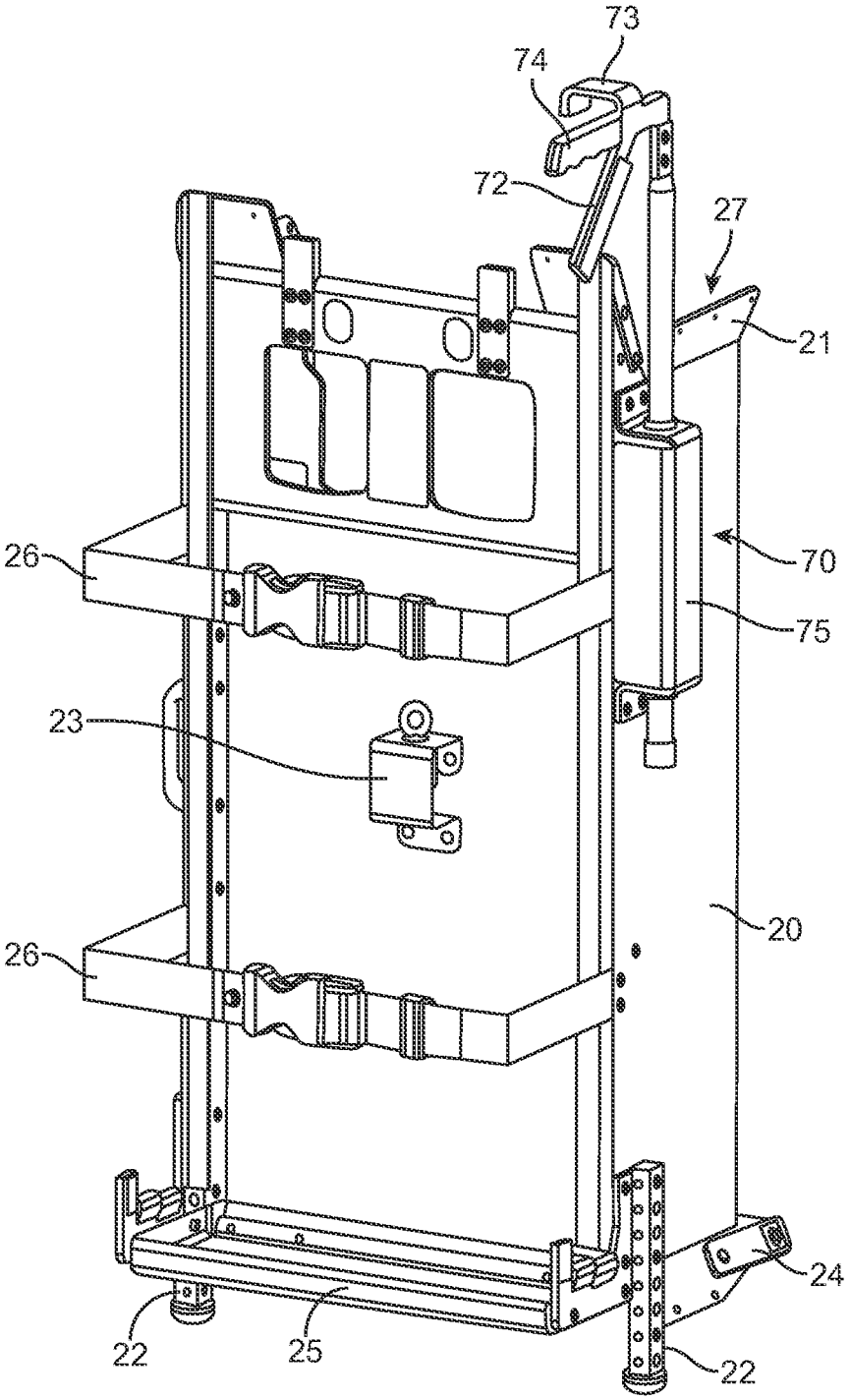
FIG. 7 is a rear perspective view of the sled.
Figure 8:
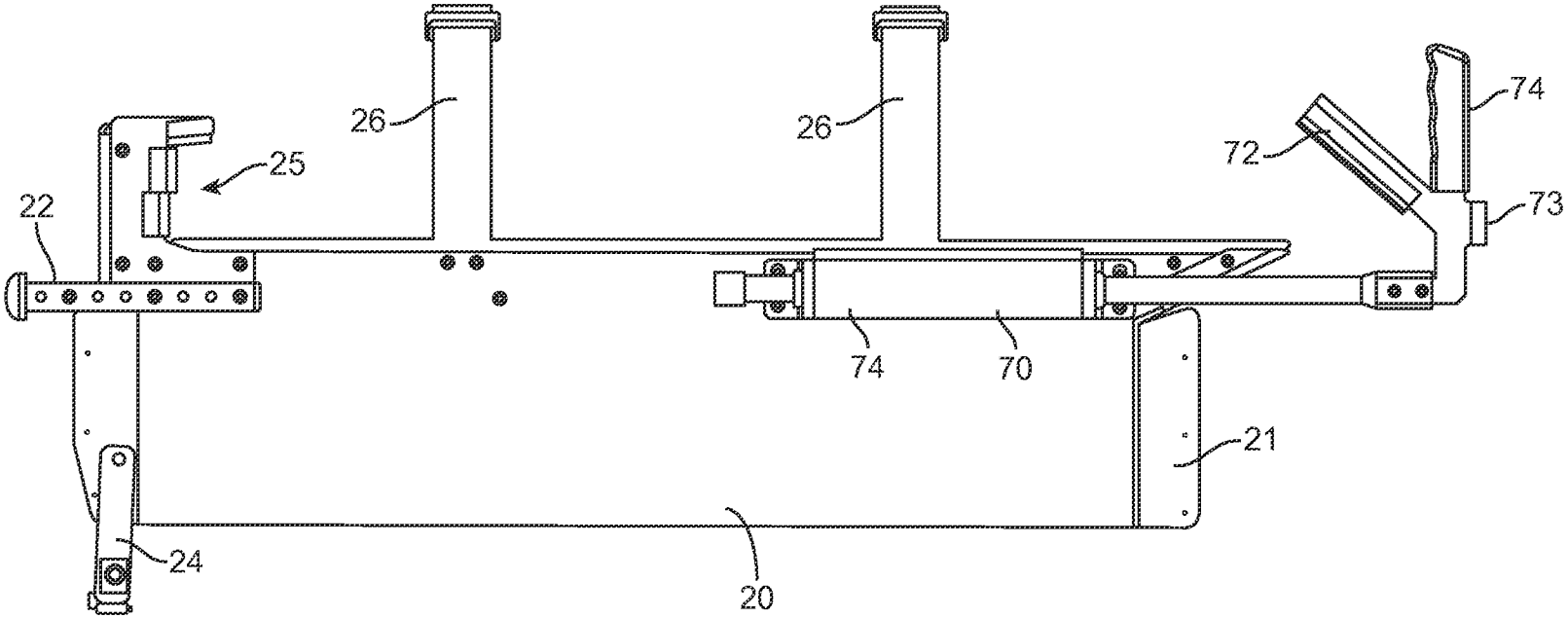
FIG. 8 is a side elevation view of the sled.
Figure 9:
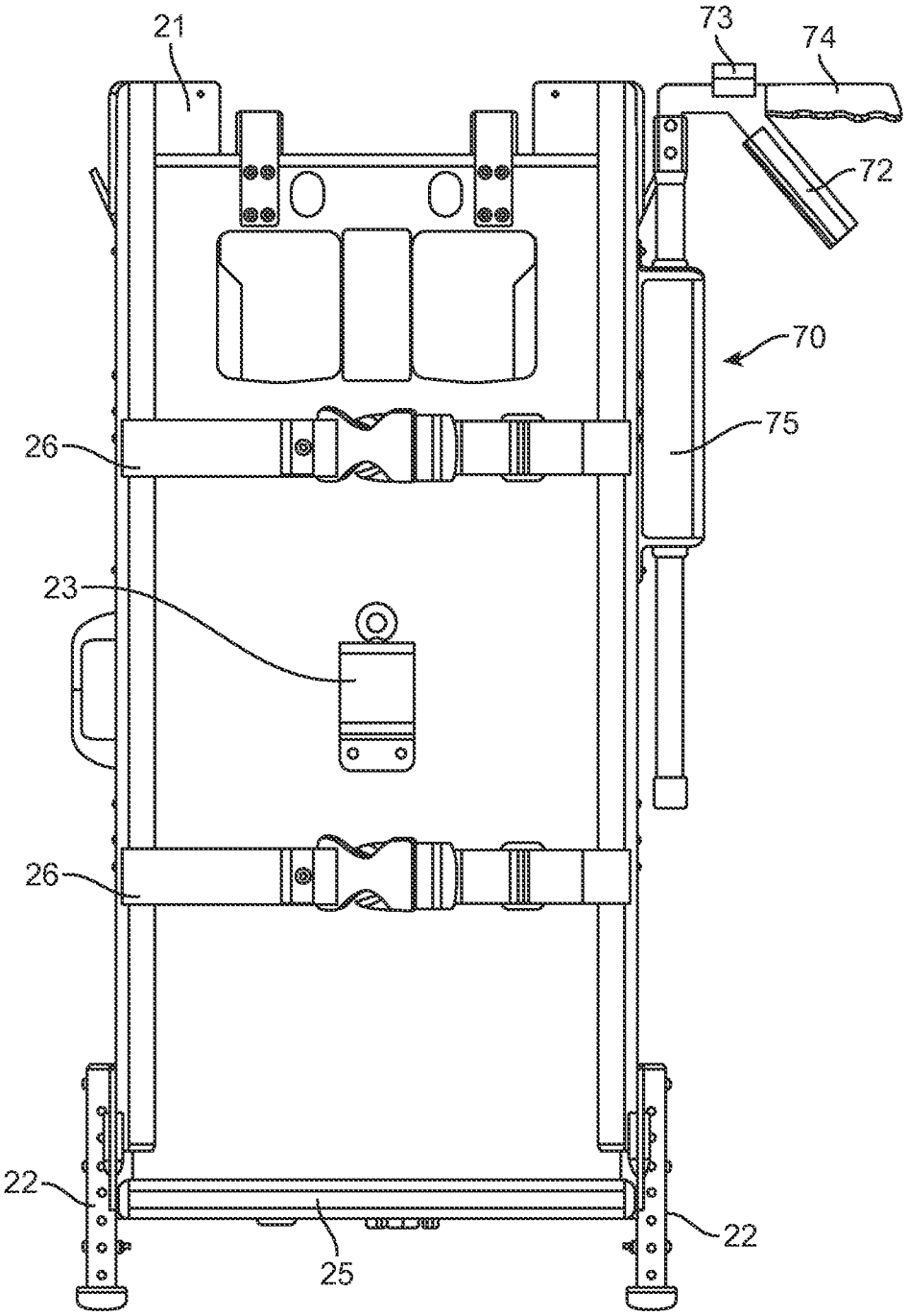
FIG. 9 is a rear elevation view of the sled.

Turning next to FIGS. 7 to 9, further details of sled 20 are shown. Sled 20 has a pair of bottom legs 22 extending from its frame. Sled 20 also has a pulley attachment hook 23 mounted onto the frame (to attach pulley 43 thereto). An optional shock absorber (80 in FIG. 17) can be installed here, as will be described below. Sled 20 also has a bottom support 25 that is preferably dimensioned to receive a pair of photovoltaic modules sitting thereon (although it is understood that the present invention also encompasses designs with one photovoltaic module or other numbers of photovoltaic modules sitting thereon). As can be seen, sled 20 has a front and two sides and thus wraps around the front and sides of the ladder, but without actually being attached to the ladder. Instead, an optional back strap 24 that can be wrapped around the back of the ladder, thereby preventing sled 20 from coming off of the ladder if high winds are pushing on the photovoltaic modules. This is especially a concern when the photovoltaic modules are first lifted above the lower edge of the building roof. Optionally, sled 20 can also have one or more front straps 26 for holding other objects like odd shaped or triangular modules, or array skirts, etc.

Commonly, ladder L will be a standard sectional ladder having sliding sections that overlap onto one another. Therefore, when sled 20 is being lifted up the ladder, it must advance over the overlapping sections of the ladder. In one preferred embodiment, this is facilitated by sled 20 having a top edge 21 dimensioned to pass over the overlapping sections of the sectional ladder. Specifically as illustrated, the top edge 21 of the sled may be angled outwardly away from the ladder. Optionally as well, an inner ladder-contacting surface of the sled may comprise a non-stick surface 27. Non-stick surface 27 may be made of low friction, low abrasion plastics like UHMW polyethelene, or other suitable material.

Preferably, sled 20 also has a photovoltaic module lock 70 for securing the photovoltaic modules to the sled. Photovoltaic module lock preferably comprises a catch 72 that is biased downwardly by a spring 76 (FIG. 10) in box 75. Lock 70 also includes a hand lever 74 for lifting and rotating catch 72. A single module catch 73 can also be included. As will be shown, hand lever 74 can be used to lift and rotate catch 72, as follows.

Figure 10:
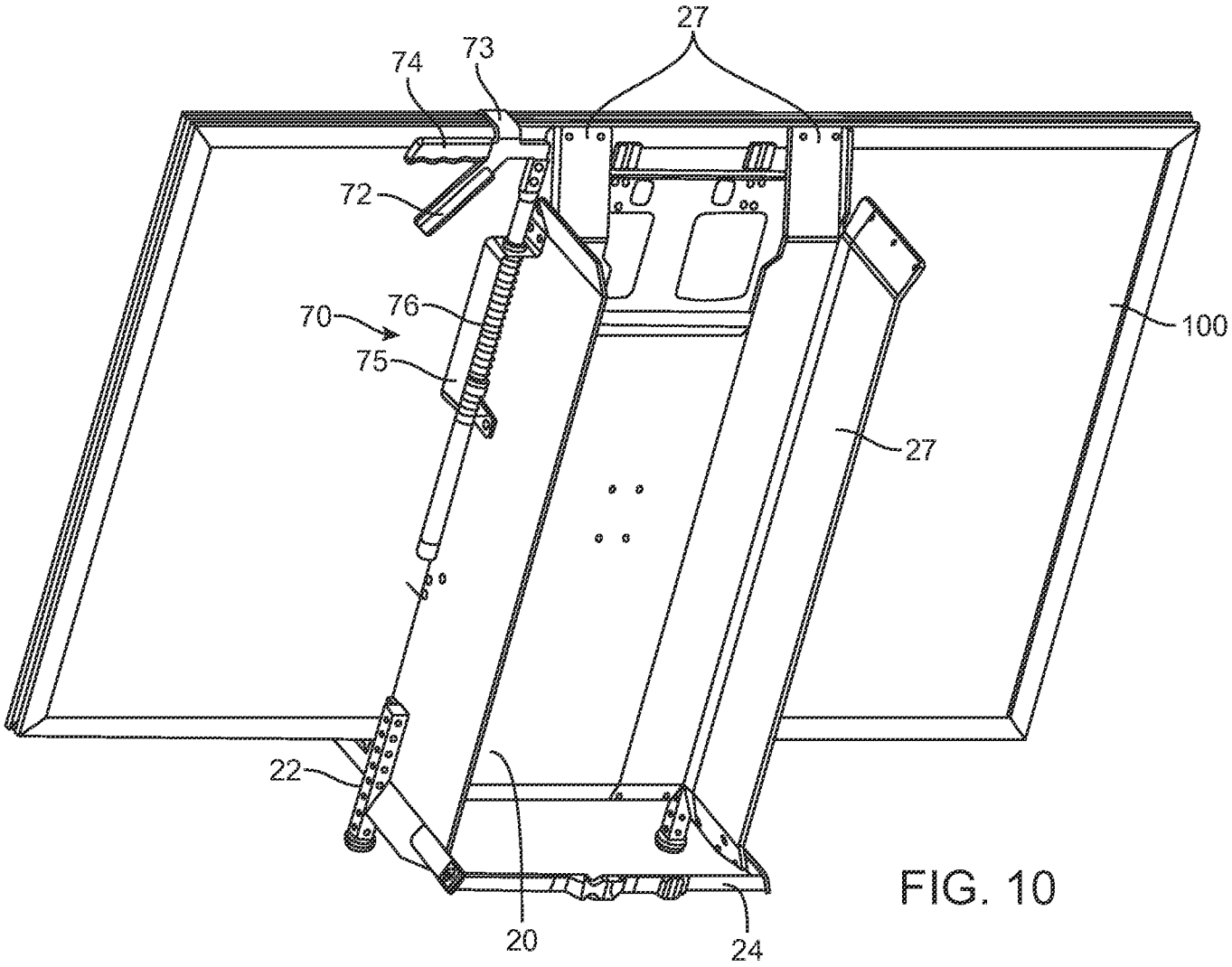
FIG. 10 is a rear perspective view of the sled with a single photovoltaic module resting thereon, with the photovoltaic module lock being engaged.

FIG. 10 shows single module catch 73 received into a side groove in photovoltaic module 100, thereby holding the photovoltaic module against sled 20. This configuration is especially useful when lifting photovoltaic modules onto the roof one at a time. As can be appreciated, the present system can be used to lift various sizes and shapes of modules, including framed and frameless modules, and framed modules both having grooved frames and having non-grooved frames.

Figure 11:
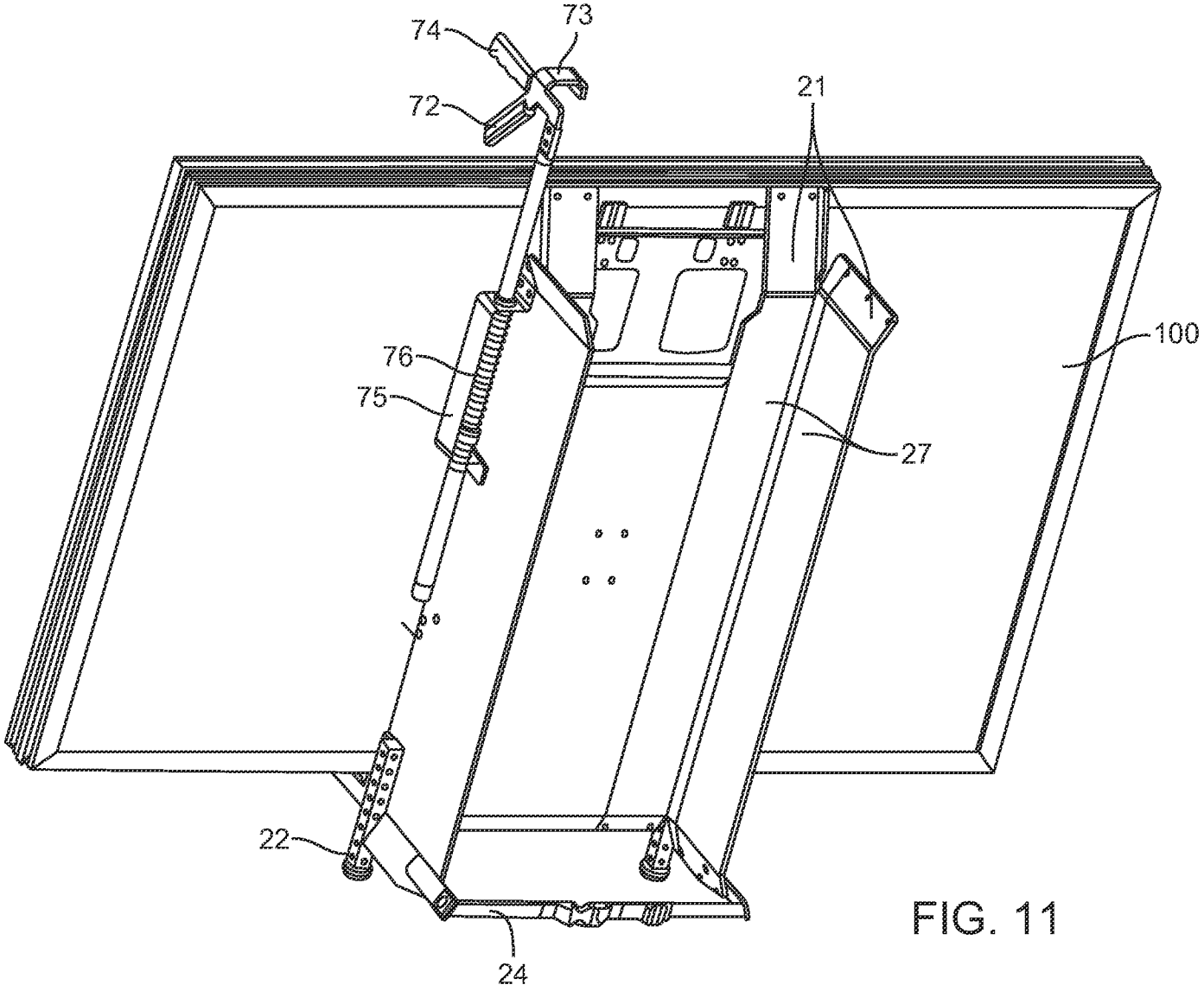
FIG. 11 is a rear perspective view of the sled with a pair of photovoltaic modules resting thereon, after the photovoltaic module lock has been lifted and rotated by 90 degrees.
Figure 12:
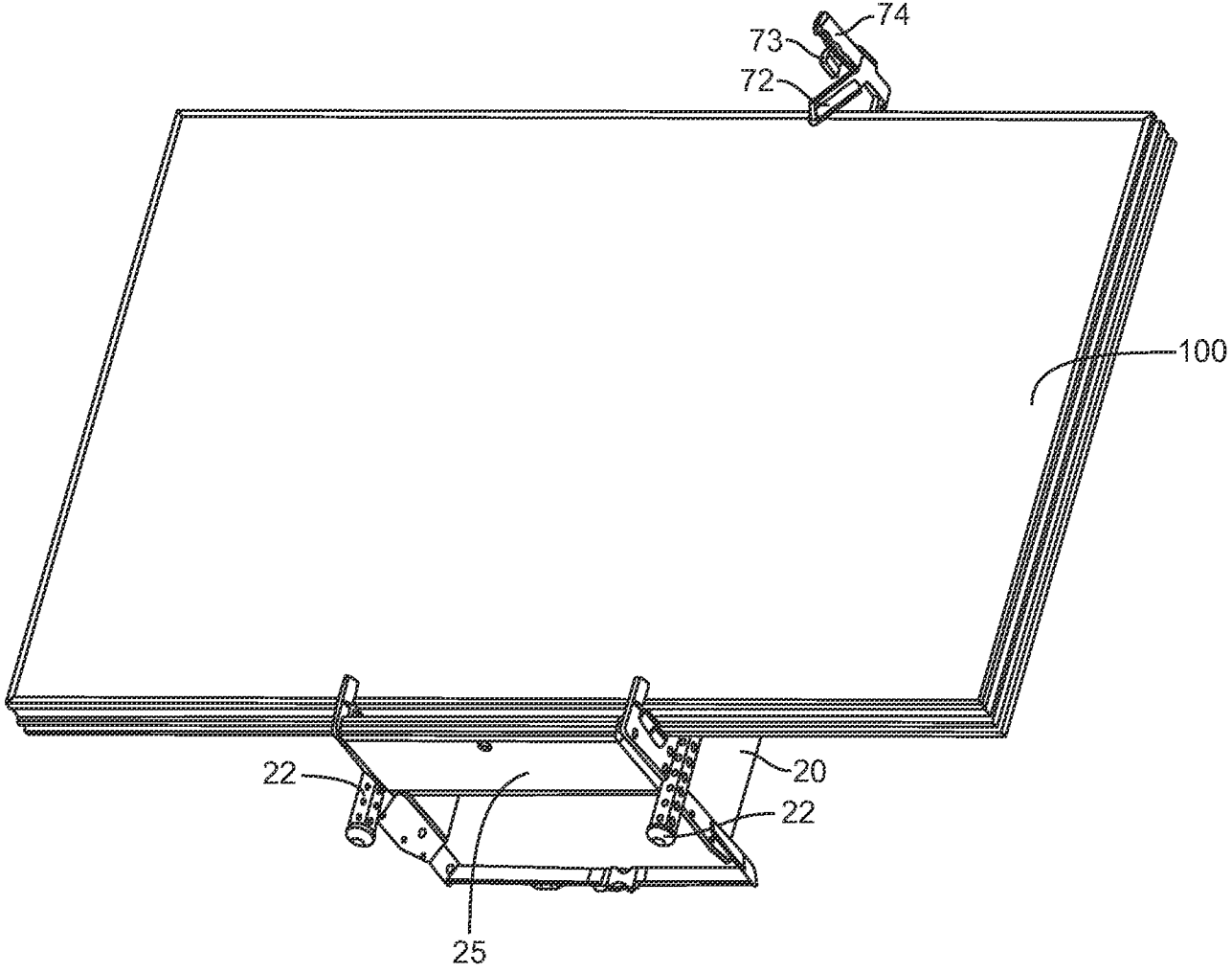
FIG. 12 is a front perspective view of the sled with a pair of photovoltaic modules resting thereon, after the photovoltaic module lock has been attached.

FIGS. 11 and 12 show a pair of photovoltaic modules 100 being attached to sled 20. This configuration is especially useful when lifting photovoltaic modules onto the roof in pairs. First, in FIG. 11, an installer simply rests photovoltaic modules 100 against the sled. Next, as seen in FIG. 12, the installer has grabbed onto lever 74, lifting and turning the catch 72 by 90 degrees, and then releasing the lever 74 such that spring 76 will then pull catch 72 downwardly firmly grasping onto the top sides of photovoltaic modules 100. As can be seen, catch 72 rests firmly on the top of modules 100, holding them securely onto sled 20.

Figure 13:
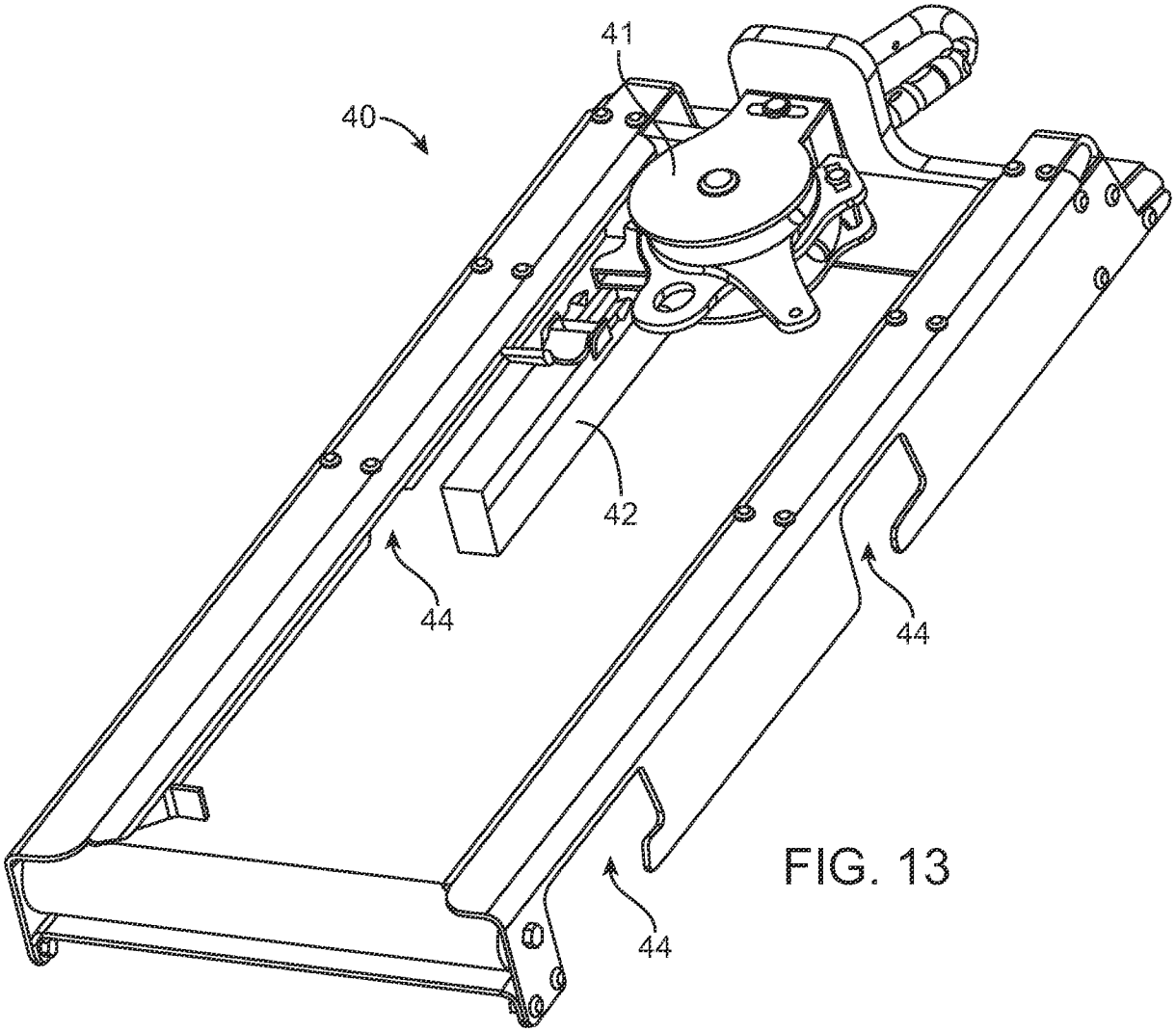
FIG. 13 is a front perspective view of the pulley assembly (with the cords removed for clarity).
Figure 14:
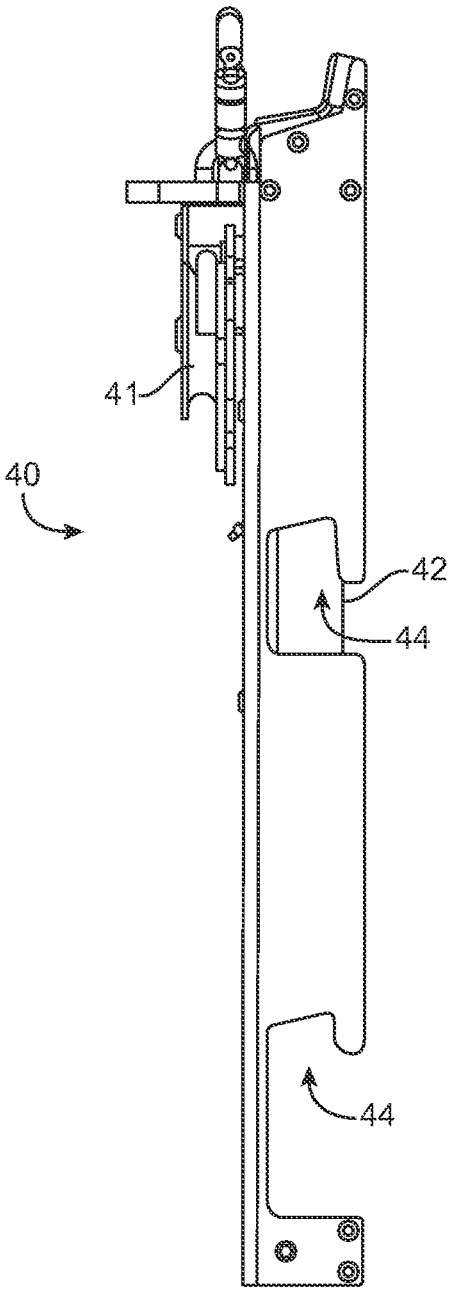
FIG. 14 is a side elevation view of the pulley assembly.
Figure 15:
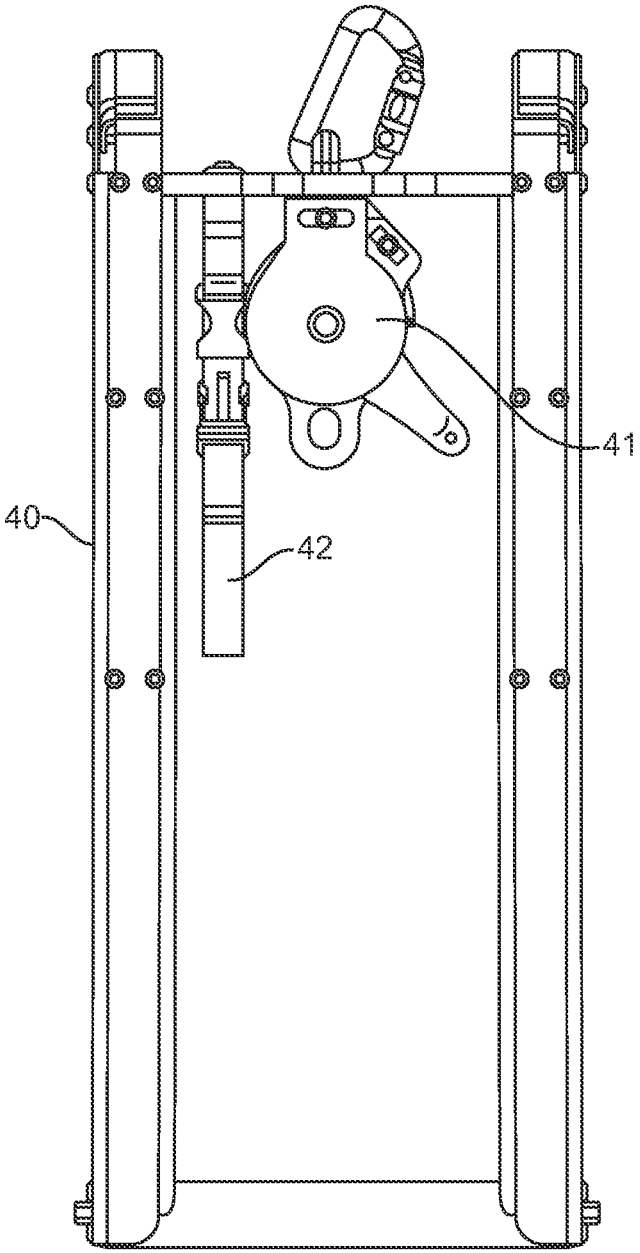
FIG. 15 is a front elevation view of the pulley assembly.

Next, FIGS. 13 to 15 show further details of the pulley assembly 40. Preferably, pulley assembly 40 includes cutaway hooks 44 which receive parallel rungs of the ladder therein. In preferred embodiments, the frame of optional roof mount 60 wraps partially around the same rungs of the ladder as the frame of pulley assembly 40. This is achieved by having hooks 64 positioned inside of cutaway hooks 44 (i.e.: positioning hooks 64 more towards the center of the ladder) when both hooks are placed the same rungs on the ladder. Cutaway hooks 44 provide an easy to install approach.

Figure 16A:
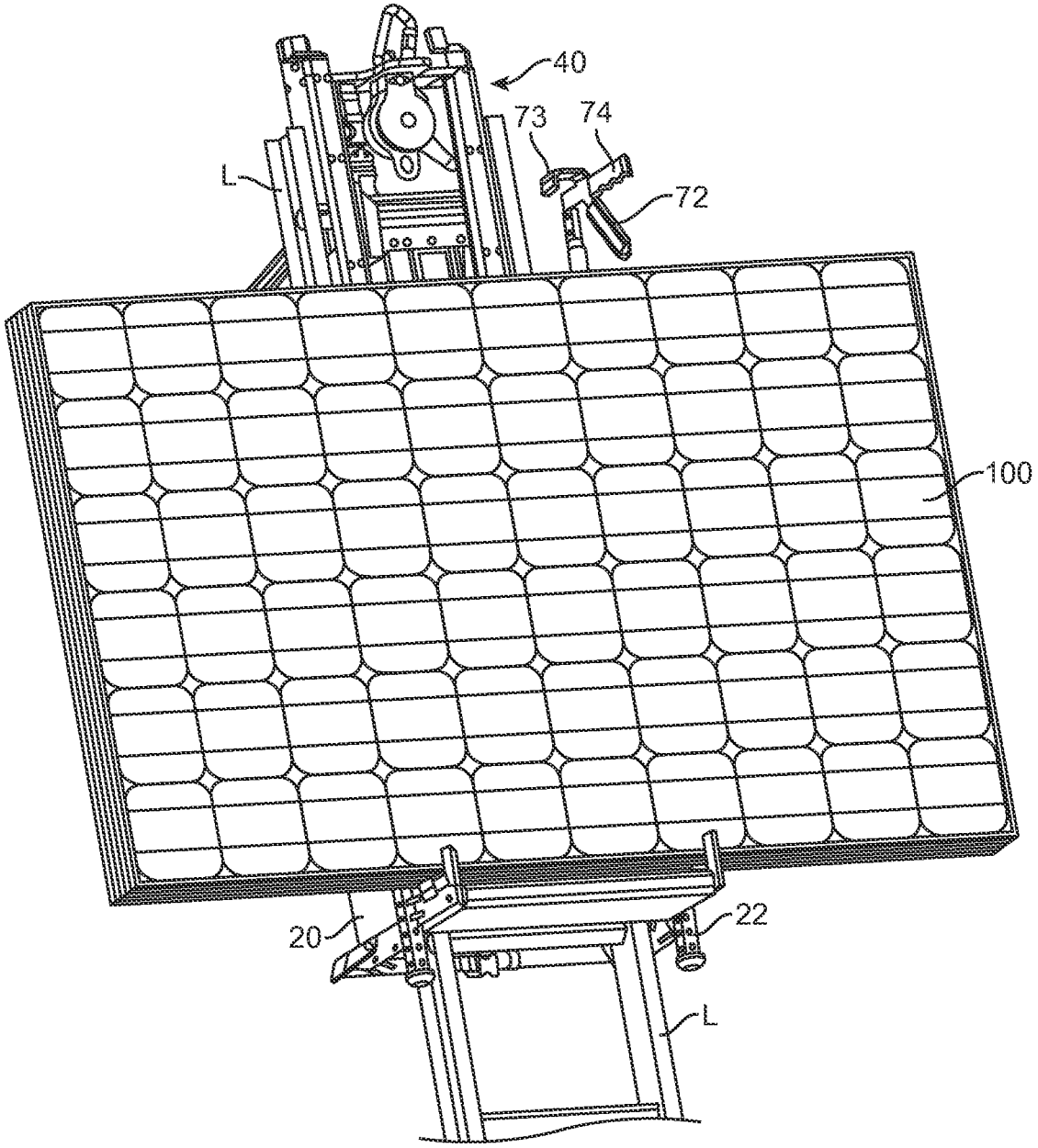
FIG. 16A is a front perspective view of the present system in operation, supporting a pair of photovoltaic modules near the top of the ladder.
Figure 16B:
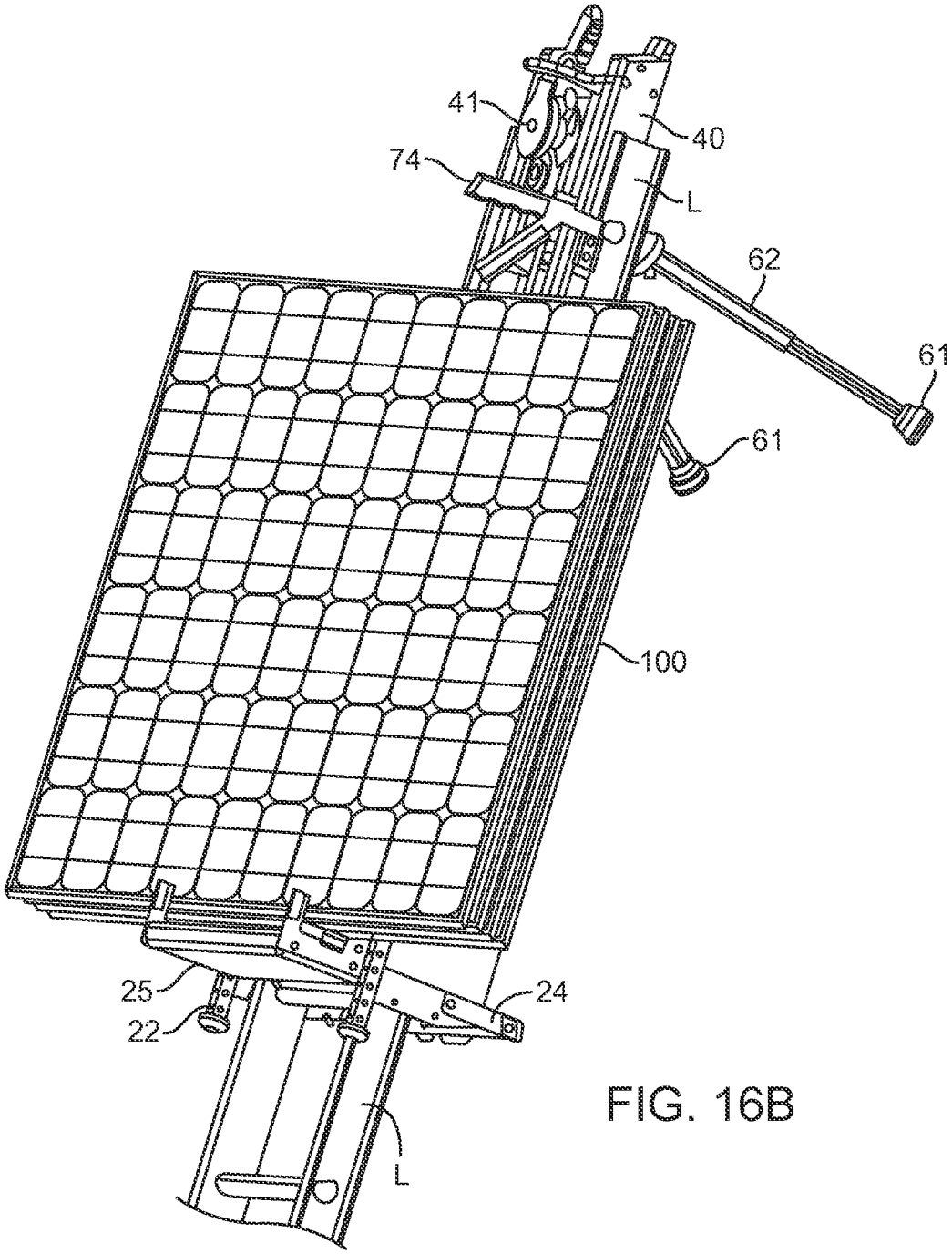
FIG. 16B is a view similar to FIG. 16A, but rotated to show the optional roof standoff.

FIGS. 16A and 16B illustrate the present system with a pair of photovoltaic modules 100 lifted up to the top of the ladder (such that an installer standing on the roof can then release catch 72, and then lift modules 100 off of the sled).

Figure 17:
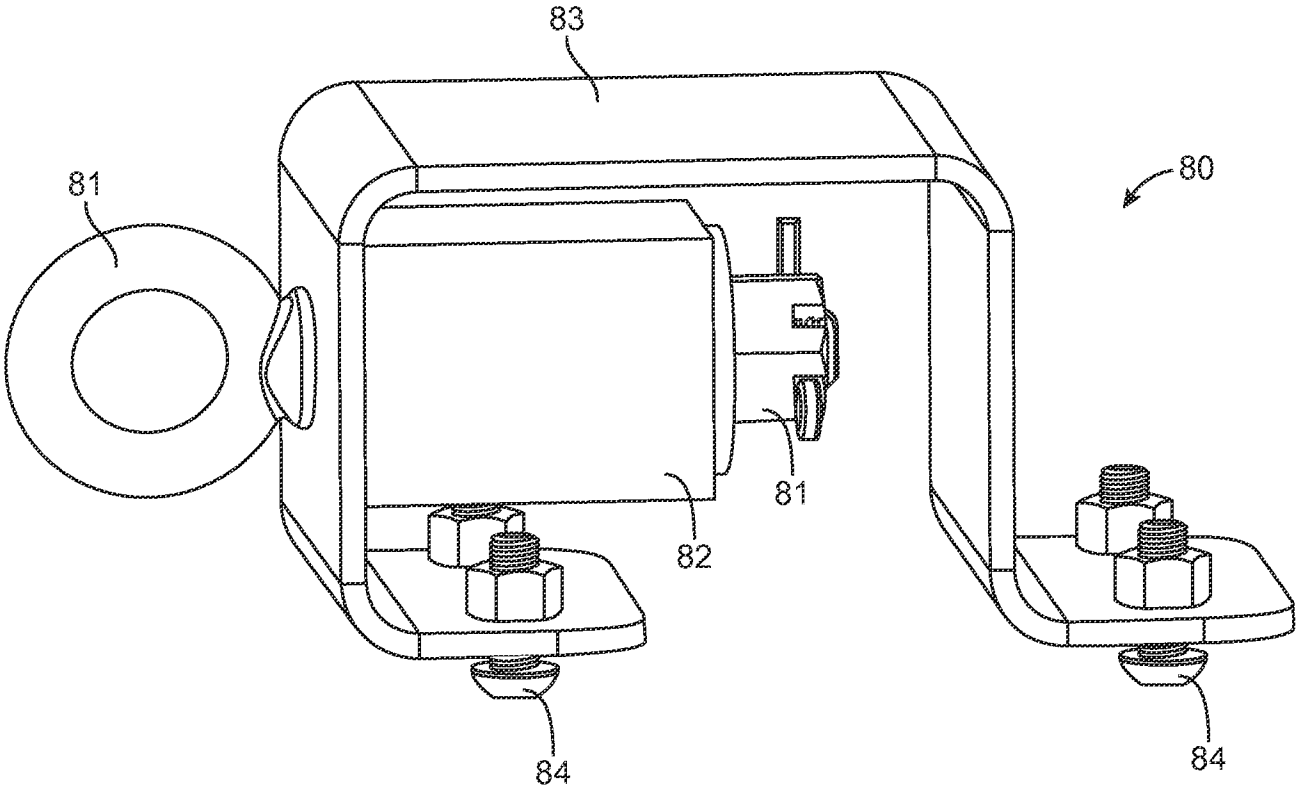
FIG. 17 is a perspective view of an optional shock absorber for use with the present system.

Lastly, FIG. 17 illustrates a shock absorber 80 having an eyebold 81 passing through a rubber block 82. In operation, shock absorber 80 can be used in lieu of pulley attachment hook 23 (FIG. 1). Specifically, member 83 has an aperture for eyebolt 81 to pass through. The advantage of shock absorber 80 is that any jerking motion on eyebolt 81 (by manually pulling chord 50) is cushioned by rubber block 82 such that such jerking motion is not transferred to member 83 (which is attached by bolts 84 to sled 20, not shown). Thus, any abrupt pulling shocks caused by the installer yanking cord 50 are not transferred to sled 20.

The present system increases safety as it provides a sturdy system for installers to lift modules. It is much safer than existing approaches that typically include simply lifting modules overhead or pulling them upwardly with a rope. The present system holds the modules securely, thereby preventing them from falling, and also provides ergonomic benefits to the installers.

What is claimed is:

1. A hand-powered hoist system, comprising:

a ladder;

a framed photovoltaic module comprising a frame defining a groove;

a sled comprising a first side facing the ladder, and a second side opposite the first side, wherein the first side comprises contact surfaces directly contacting outer surfaces of the ladder and configured to slide along the ladder, wherein the second side comprises a bottom surface directly contacting and supporting a bottom edge of the frame of the photovoltaic module, and wherein the sled further comprises a photovoltaic module lock comprising a catch received within the groove at a top edge of the frame of the photovoltaic module securing the photovoltaic module to the sled;

a pulley assembly mounted at a top of the ladder; and a lifting cord connecting the pulley assembly to the sled, wherein the lifting cord is configured to be pulled by hand to lift the sled and the photovoltaic module secured to the sled up the ladder.

2. The hoist system of claim 1, wherein the ladder is a sectional ladder and the contact surfaces comprise a top edge dimensioned to pass over overlapping sections of the sectional ladder.

3. The hoist system of claim 2, wherein the top edge of the contact surfaces is angled outwardly away from the ladder.

4. The hoist system of claim 2, wherein contact surfaces of the sled comprise a non-stick surface.

5. The hoist system of claim 1, further comprising:

a roof mount at the top of the ladder, the roof mount comprising a frame with a pair of legs extending therefrom.

6. The hoist system of claim 5, wherein the frame of the roof mount is received onto a first set of rungs of the ladder.

7. The hoist system of claim 6, wherein a frame of the pulley assembly is received onto the first set of rungs.

8. The hoist system of claim 1, wherein the catch is biased downwardly by a spring.

9. The hoist system of claim 8, wherein the catch is rotatable from a position parallel to the photovoltaic module to a position perpendicular to the photovoltaic module.

10. The hoist system of claim 9, wherein the photovoltaic module lock comprises a hand lever for lifting and rotating the catch.

11. A hand-powered photovoltaic module hoist system, comprising:

a ladder;

a framed photovoltaic module comprising a frame defining a groove;

a sled configured to slide up and down along the ladder, the sled wrapping around front and sides of the ladder, the sled not being attached to the ladder, wherein the sled comprises a photovoltaic module lock with a catch received within the groove of the photovoltaic module securing the photovoltaic module to the sled;

a pulley assembly attached to a removable frame that is mounted at a top of the ladder, the removable frame being received onto rungs of the ladder; and a lifting cord connecting the pulley assembly to the sled, wherein the lifting cord can be pulled by hand to lift the sled up the ladder.

12. The hoist system of claim 11, wherein the ladder is a sectional ladder and the sled comprises a top edge dimensioned to pass over overlapping sections of the sectional ladder.

13. The hoist system of claim 11, wherein an inner ladder-contacting surface of the sled comprises a non-stick surface.

14. The hoist system of claim 11, wherein the catch is biased downwardly by a spring.

* * * * *